US006755395B2

(12) United States Patent
Nickel

(10) Patent No.: US 6,755,395 B2
(45) Date of Patent: Jun. 29, 2004

(54) CARBURETION ARRANGEMENT FOR AN INTERNAL COMBUSTION ENGINE OF A MANUALLY GUIDED IMPLEMENT

(75) Inventor: Hans Nickel, Cottenweiler (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 10/319,757

(22) Filed: Dec. 13, 2002

(65) Prior Publication Data

US 2003/0116870 A1 Jun. 26, 2003

(30) Foreign Application Priority Data

Dec. 22, 2001 (DE) ..... 101 63 805

(51) Int. Cl.[7] ..... F02M 13/04
(52) U.S. Cl. ..... 261/23.2; 261/DIG. 1
(58) Field of Search ..... 261/23.2, 23.3, 261/35, DIG. 1

(56) References Cited

U.S. PATENT DOCUMENTS 3,205,879 A * 9/1965 Von Seggern et al. ..... 261/23.2
3,742,922 A * 7/1973 Hisatomi et al. ..... 261/23.2
4,019,477 A * 4/1977 Overton ..... 261/23.2
4,086,885 A * 5/1978 Noguchi et al. ..... 261/23.2
4,144,861 A * 3/1979 Yamashita et al. ..... 261/23.2
4,178,331 A * 12/1979 Emmons ..... 261/23.2
4,414,162 A * 11/1983 Ii et al. ..... 261/23.2
4,452,218 A * 6/1984 Yokoyama et al. ..... 261/23.2
4,487,185 A * 12/1984 Yokoyama et al. ..... 261/23.2

* cited by examiner

*Primary Examiner*—Richard L. Chiesa
(74) *Attorney, Agent, or Firm*—R W Becker & Associates; R W Becker

(57) ABSTRACT

A carburetion arrangement for an internal combustion engine of a manually guided implement is provided. The arrangement includes a carburetor having an air channel, the cross-section of which is variable via a butterfly valve. An auxiliary carburetor having an auxiliary air channel is, in a flow conducting manner, connected in parallel to the air channel, whereby the auxiliary air channel opens into the air channel downstream of the butterfly valve. Disposed in the auxiliary air channel is a starting valve that includes a flow control device, wherein the starting valve alters the flow resistance of the flow control device as a function of the differential pressure that is present.

12 Claims, 5 Drawing Sheets

CARBURETION ARRANGEMENT FOR AN INTERNAL COMBUSTION ENGINE OF A MANUALLY GUIDED IMPLEMENT

BACKGROUND OF THE INVENTION

The present invention relates to a carburetion arrangement for an internal combustion engine of a manually guided implement, with the arrangement including a carburetor that has an air channel, the cross-section of which is variable via a butterfly valve.

To achieve a high power, and to fulfill the respectively applicable emissions standards, manually guided implements having an internal combustion engine and a carburetor are provided with an appropriate setting of the fuel/air ratio that is set to a hot running condition of the internal combustion engine. Thus, when the internal combustion engine is started after longer periods of rest, and in particular at low ambient temperatures, the mixture prepared by the carburetor is too lean, which can lead to starting difficulties.

To improve the starting condition, especially the cold starting condition of the internal combustion engine, arrangements are known for enriching the mixture during the starting phase. For example, an increased underpressure can be produced in the intake channel by means of a starter valve that is disposed in the air channel of the carburetor upstream of the butterfly valve. As a result of the increased underpressure, an increased quantity of fuel is drawn in relative to the quantity of air that is drawn in through the internal combustion engine. The mixture becomes richer, thus improving the starting conditions. Shortly after the internal combustion engine has started, the starter valve is to be opened by the operator, thereby establishing the mixture ratio of the fuel/air mixture ratio of the fuel/air mixture that is provided for normal operation. The control of the position of the starter valve requires the attentiveness of the operator. If the starter valve is opened too late, the rich fuel/air mixture can cause the engine to die.

It is therefore an object of the present invention to provide a carburetion arrangement for an internal combustion engine of a manually guided implement with which the starting characteristics of the engine are improved.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
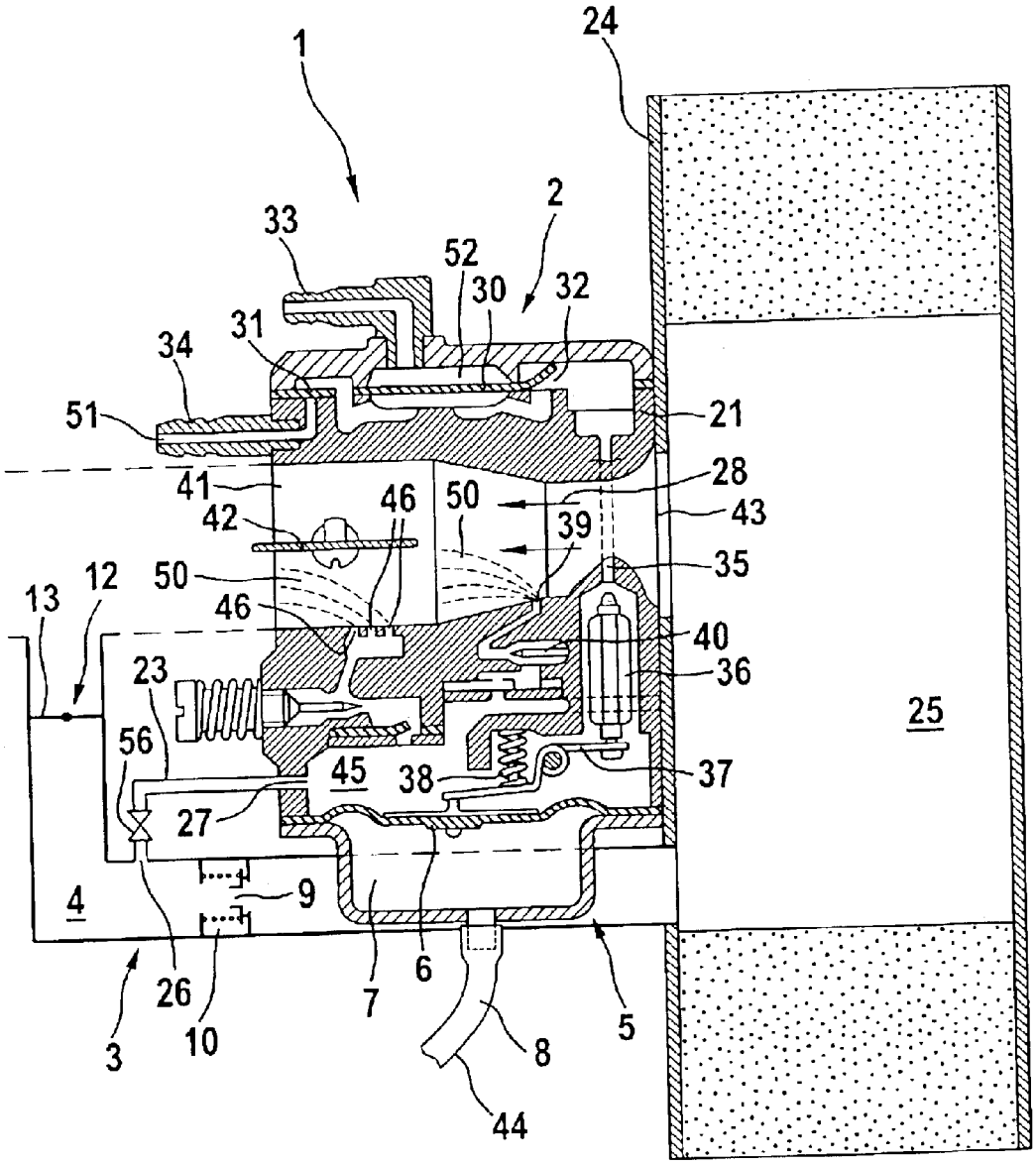
FIG. 1 is an overview of the diaphragm carburetor in the full throttle position of its butterfly valve with an auxiliary carburetor connected in parallel, and with a closed shutoff valve.

The present invention proposes an arrangement that includes an auxiliary carburetor having an auxiliary air channel, whereby the auxiliary carburetor is connected, in a flow conducting manner, parallel to the air channel of the carburetor, whereby the cross-section of the air channel is variable via a butterfly valve; downstream of the butterfly valve, the auxiliary air channel opens into the air channel of the carburetor. In this connection, a starting valve having a flow control device is disposed in the auxiliary air channel. The starting valve is embodied such that it alters the flow resistance of the flow control device as a function of the differential pressure that is present. During a starting process, the internal combustion engine draws in air via the auxiliary carburetor. As a consequence of the flow control device, a relative underpressure results on its downstream side. In the underpressure zone of the auxiliary carburetor, fuel is drawn in for the formation of a fuel/air mixture, which is set sufficiently rich for the starting process. In the state of rest, the flow control device has a relatively high flow resistance, as a result of which on a downstream side a high underpressure, and hence a high fuel feed rate, result. At the beginning of the starting process, for example by activating a pull cord starter, there is produced in the auxiliary carburetor a rich fuel/air mixture that is set such that initial ignition can be reliably provided for a cold internal combustion engine. After the initial ignition, accompanied by automatic running of the engine, the differential pressure at the flow control device in the auxiliary carburetor increases, as a result of which the starting valve automatically reduces the flow resistance of the flow control device. Consequently, the fuel/air mixture formed in the auxiliary carburetor becomes leaner to such an extent that the internal combustion engine can automatically continue to run. As a consequence of this arrangement, a respectively optimum fuel/air ratio can be automatically set for the various starting phases. To enhance the initial ignition process during starting, the fuel/air mixture is initially greatly enriched. The alteration of the flow resistance of the flow control device, which is a function of the differential pressure, leads immediately after start-up of the internal combustion engine to a leaner mixture that reliably ensures that the engine will continue to run. Subsequently, the carburetor can be converted by the operator to a conventional operating mode. The structural and production expense of a starter valve, and the time-critical actuation thereof, are eliminated.

Pursuant to one advantageous embodiment of the invention, the starting valve is embodied as a control valve that can be switched between two states having two different flow resistances. Such a valve has a simple construction and is economical to produce. Intermediate positions of the valve having undefined flow resistances are avoided.

Pursuant to an expedient further development of the invention, a shutoff valve is provided for the auxiliary carburetor, as a result of which the function of the auxiliary carburetor can be shut off after a successful starting of the internal combustion engine. This ensures that during a hot-running condition of the internal combustion engine, the mixture formation by the carburetor is not adversely affected by the auxiliary carburetor. In this connection, the shutoff valve is expediently coupled with the butterfly valve, whereby in particular the shutoff valve is opened in a starting position of the butterfly valve that essentially sealingly closes off the air channel of the carburetor, and whereby in an operating position that at least partially opens the air channel of the carburetor the shutoff valve is closed. With such an arrangement, for example with a single lever connection, the carburetion arrangement can be brought to a starting position. In this connection, the air channel of the carburetor is essentially sealingly closed by the butterfly valve, whereby a mixture formation in this region that could adversely affect the starting process is precluded. The shut-off valve is simultaneously opened, as a result of which the internal combustion engine can be reliably started in the manner described above. After the engine is started, the operator can, in a manner that is not time critical, bring the butterfly valve from the closed starting position into any desired operating position. As a consequence of being coupled to the butterfly valve, the auxiliary carburetor is thereby shut off. The mixture formation in the carburetor is effected in an undisturbed manner with a fuel/air ratio that is set for a good motor power and/or good emission quality. The coupling of the shutoff valve with the butterfly valve avoids incorrect operation.

The starting valve expediently includes a valve plate that is provided with a restrictor opening and that is pressed against a valve seat by means of a pre-load of a spring element. As a consequence of the restrictor opening of the valve plate, the flow resistance of the flow control device is prescribed at the beginning of the starting process. As the differential pressure rises at the valve plate, the latter is raised from the valve seat against the pre-load force of the spring element, as a result of which additional air can flow about the valve plate. The overall flow resistance is thereby decreased. A desired leaner fuel/air mixture consequently occurs. Such a construction is straightforward and functions reliably. For this purpose, there are expediently provided a valve housing and a threaded sleeve that in particular is provided with the valve seat and can be threaded into the valve housing. The spring element is held between the threaded sleeve or the valve plate, and a counter bearing in the valve housing. When the threaded sleeve is screwed in, the spring element is pre-loaded. The pre-load of the spring element can be adjusted by selecting the depth to which the sleeve is threaded in. As a result of this arrangement, it is easy to set the point of switching between the two throttling conditions of the flow control device.

If the valve housing is embodied as a screw-type fitting that can be threaded into a carburetor block, the valve housing can easily be produced as an individual component. Existing carburetor constructions can easily and inexpensively be provided with an auxiliary air channel and can be modified by threading the screw-type fitting into the inventive carburetion arrangement. For mass production conditions, it is expedient to embody the valve housing, the threaded sleeve and/or the valve plate out of polymeric material, and in particular out of POM, namely polyoxymethylene, and also including polyformaldehyde and polyacetals. Pursuant to an expedient alternative, the valve housing is monolithically embodied with the carburetor block of the carburetor, thus saving manufacturing costs.

Further specific features of the present invention will be described in detail subsequently.

DESCRIPTION OF PREFERRED EMBODIMENTS

Referring now to the drawings in detail, the schematic sectional illustration of FIG. 1 shows a carburetion arrangement 1 having a diaphragm carburetor 2 through which extends an air channel 41. The cross-sectional area of the air channel 41 can be varied by means of a butterfly valve 42 for the control of the power of a non-illustrated internal combustion engine of a manually-guided implement. The butterfly valve 42 is shown disposed parallel to an intake air stream 28, which corresponds to the full throttle position of the diaphragm carburetor 2. An end 43 of the air channel 41 on the side of an air filter communicates with a clean air side 25 of an intake air filter 24 through which the non-illustrated internal combustion engine draws in the intake air stream in the direction of the arrows 28.

Fuel 51 flows via a fuel line 34 into the diaphragm carburetor 2. The fuel 51 is conveyed via a diaphragm pump 52, which includes a pump diaphragm 30, an inlet valve 31 and an outlet valve 32. By means of a pressure connection 33 that communicates with the crankcase of the internal combustion engine, the diaphragm pump 52 is acted upon by the changing pressure of the crankcase.

The fuel feed into a regulating chamber 45 is controlled via a feed valve 35 by a regulating diaphragm 6 that separates the regulating chamber 45 from a compensation chamber 7. The compensation chamber 7 is connected with a suitable control pressure source via a regulating pressure line 8 in the form of a hose 44. The regulating diaphragm 6 is connected via a valve lever 37 with the valve body 36 of the feed valve 35, through which the fuel 51 flows to the regulating chamber 45. The feed valve 35 is spring loaded in the closed position via a valve spring 38 that acts upon the valve lever 37. As a function of the pressure difference on both sides of the regulating diaphragm 6, the valve body 36 is moved against the pre-loading force of the valve spring 38, and hence regulates the fuel feed.

The fuel 51 flows out of the regulating chamber 45 into the air or intake channel 41 via a full throttle opening 39. The full throttle opening 39 can be embodied as a fixed nozzle and in the illustrated embodiment is adjustable via a main setscrew 40. In the intake channel 41, the fuel 51 mixes with the combustion air stream 28 to form a fuel/air mixture 50. The throughput of the fuel/air mixture 50 through the diaphragm carburetor 2 is controlled via the butterfly valve 42. To prepare a fuel/air mixture 50 in an idling position, as well as for support in the full throttle position, a number of idling openings 46 are provided.

Inserted parallel to the air channel 41 is an auxiliary carburetor 3 having an auxiliary air channel 4, one end of which opens into the clean air side 25 of the intake air filter 24, while the opposite end opens into the air channel 41 downstream of the butterfly valve 42. Disposed in the auxiliary air channel 4 is a kick-off or starting valve 10 having a flow control device 9 as well as a further butterfly valve 13. On that side of the flow control device 9 remote from the air filter 24, a fuel line 23 having a start opening 26 opens into the auxiliary air channel 4. The opposite end 27 of the fuel line 23 communicates with the regulating chamber 45. Depending upon the application, it can also be expedient to connect the end 27 of the fuel line 23 in the region of the outlet valve 32 of the diaphragm pump 52, or with some other suitable location of the fuel supply. Disposed in the fuel line 23 is a controllable fuel valve 56 that together with the further butterfly valve 13 forms a shutoff valve 12 for the auxiliary carburetor 3. In conjunction with the opened butterfly valve 42, the auxiliary air channel 4 is closed via the further butterfly valve 13 and the fuel line 23 by means of the fuel valve 56, thereby shutting off the auxiliary carburetor 3. Instead of the illustrated diaphragm carburetor 2, a carburetion arrangement 1 having some other suitable carburetor together with an auxiliary carburetor 3 can also be expedient.

Figure 2:
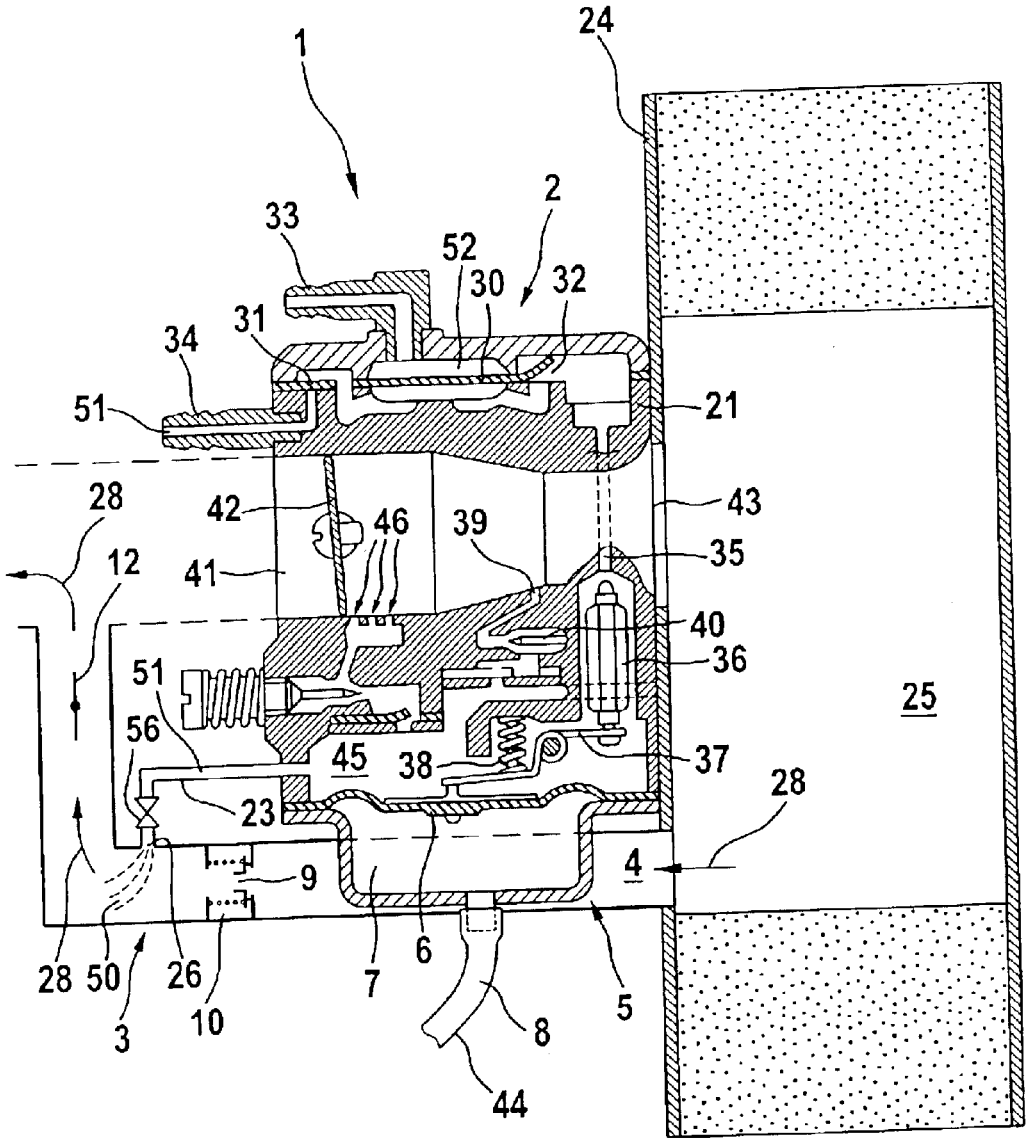
FIG. 2 shows the arrangement of FIG. 1 with the butterfly valve closed in the starting position, and with the shutoff valve of the auxiliary carburetor opened.

FIG. 2 shows the arrangement of FIG. 1, with the butterfly valve 2 shown in a start position that essentially tightly closes off the air channel 41. The shut off valve 12 and the fuel valve 56 are connected via a non-illustrated lever mechanism with the butterfly valve 42, and are fully opened in the illustrated closed position of the butterfly valve 42. During the process of starting the internal combustion engine, the intake air stream is guided in the direction of the arrow 28 through the auxiliary carburetor 3 and its auxiliary air channel 4. In so doing, downstream of the flow control device 9 fuel 51 is drawn in through the fuel line 23, whereby a rich fuel/air mixture 50 is formed. The varying control of the mixture formation by means of the starting valve 10 is described in greater detail in conjunction with FIGS. 4 and 5.

Figure 3:
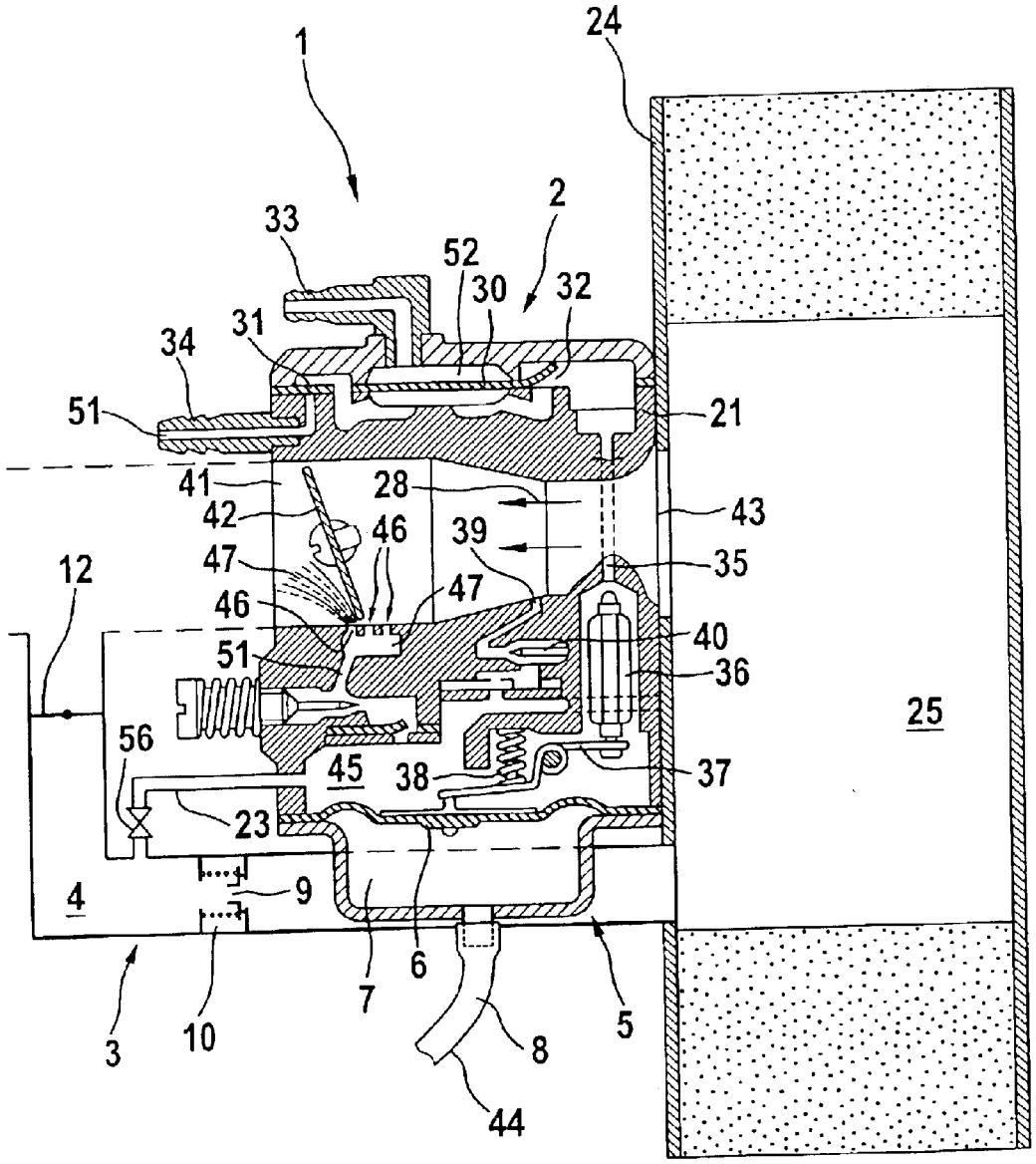
FIG. 3 shows the arrangement of FIG. 1 with the butterfly valve in the idling position.

FIG. 3 shows the arrangement of FIGS. 1 and 2 shortly after the process of starting the internal combustion engine has been effected. In this connection, the butterfly valve 42 is brought from the closed starting position shown in FIG. 2 into an idling position. Coupled therewith, the shutoff valve is closed. In the illustrated idling position of the butterfly valve 42, a portion of the intake air stream 28 is drawn into those portions of the idling openings 46 disposed upstream of the butterfly valve 42 for mixture with fuel 51. Subsequently, a fuel/air emulsion 47 exits those idling openings 46 that are disposed downstream of the butterfly valve 42 for forming an idling mixture for the internal combustion engine during idling. The remaining features and numerals of FIGS. 2 and 3 correspond with the arrangement of FIG. 1.

Depending upon the application, a coupling of the shut off valve 12 with the butterfly valve 42 can also be expedient in such a way that, for example in the idling position of the butterfly valve 42, the shutoff valve 12 is still partially opened. In addition to a mechanical coupling of the shutoff valve 12 with the butterfly valve 42, it will also be possible to provide an electrical or pneumatic coupling, whereby a pneumatic coupling can in particular be effected via the underpressure in the air channel 41. A manual control of the shut off valve 12 uncoupled from the butterfly valve 42 can also be expedient. In addition to the illustrated embodiment of the shutoff valve 12 having a further butterfly valve 13, an adjustable starting valve 10, or an adjustable flow control device 9, or a sole blocking of the fuel line 23 can also be provided. In the illustrated embodiment, the auxiliary carburetor 3 having the auxiliary air channel 4 is embodied separately from the carburetor block 21.

Figure 4:
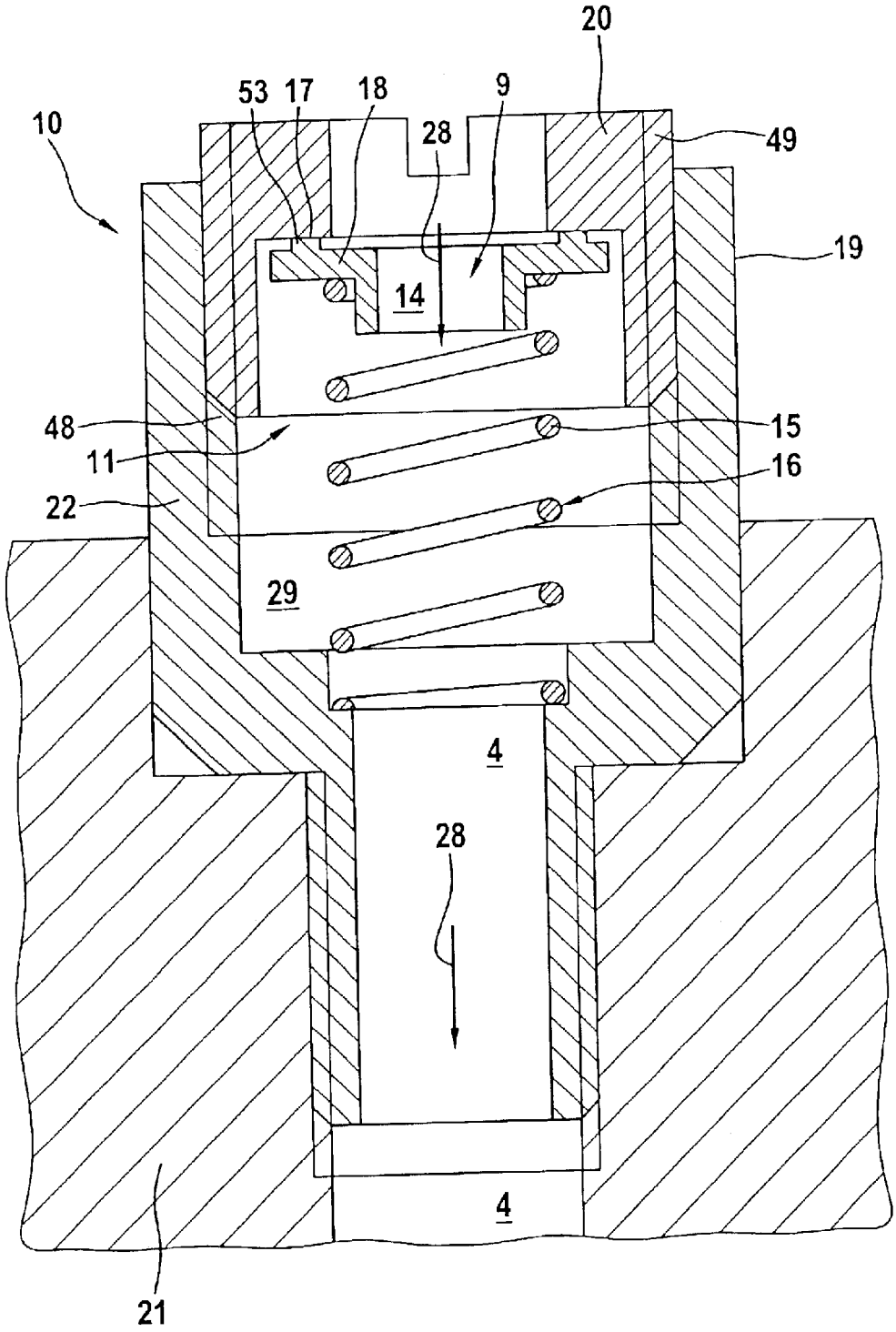
FIG. 4 is a longitudinal cross-sectional view of the starting valve embodied as a screw-type fitting, with a valve plate resting against a valve seat.

The longitudinal cross-sectional view of FIG. 4 shows one embodiment of a starting valve 10, the valve housing 19 of which is embodied as a screw-type fitting 22. An inner chamber 29 of the valve housing 19 is provided with an internal thread 48 into which a threaded sleeve 20 is screwed. Disposed in the inner chamber 29 is a valve plate 18 having a central restrictor opening 14; by means of the spring element 15, the valve plate 18 is pressed under pressure pre-load against the threaded sleeve 20. The valve plate 18 has an annular bead 53 that surrounds the opening 14 and via which the valve plate rests sealingly against a valve seat 17 of the threaded sleeve 20. In so doing, the restrictor opening 14 forms the flow control device 9 for the intake air stream 28.

In the illustrated embodiment, the spring element 15 is in the form of a compression spring 16. However, any other suitable spring element 15 could also be provided. The valve housing 19, the valve plate 18 and the threaded sleeve 20 are made of polymeric material, and in the illustrated embodiment are made of POM. An embodiment in aluminum or some other metal could also be expedient. In the illustrated embodiment, the screw-type fitting 22 is threaded into the carburetor block 21, whereby the auxiliary air channel 4 together with the start opening 26 (FIG. 2) are integrated for formation of the auxiliary carburetor 3 in the carburetor block 21.

By selection of the depth of threading of the threaded sleeve 20 into the valve housing 19, the pre-load force of the compression spring 16, and hence the bearing force of the valve plate 18 against the valve seat 17, are adjustable. In the illustrated position where the valve plate 18 rests against the valve seat 17, there is effected via the restrictor opening 14 a relatively great throttling of the intake air stream 28 at the beginning of the process of starting the internal combustion engine. Consequently, a relatively rich fuel/air mixture 50 is formed in the auxiliary carburetor 3 (FIG. 2).

Figure 5:
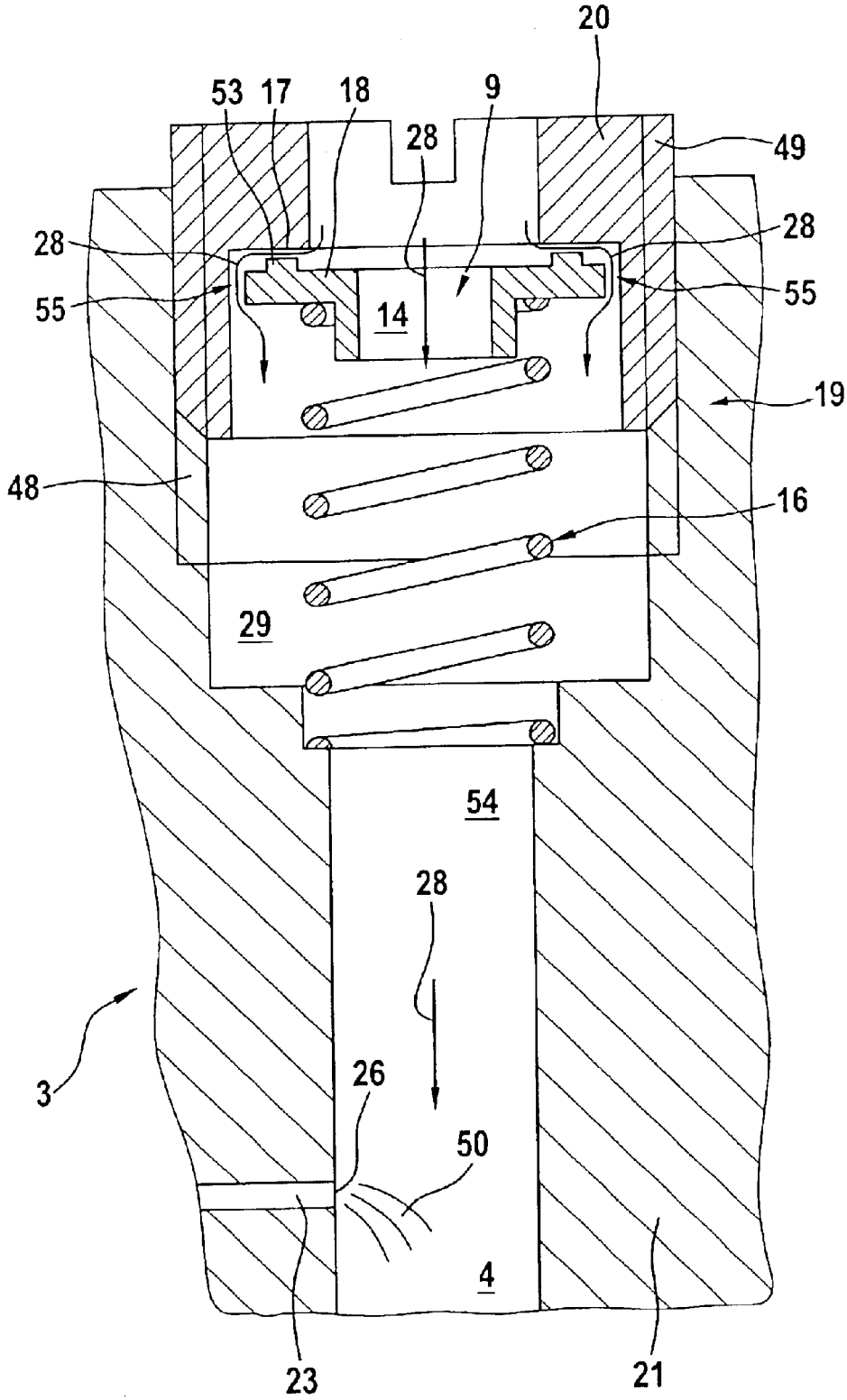
FIG. 5 shows a variation of FIG. 4 with a valve housing as part of the carburetor block, and with the valve plate raised from the valve seat.

FIG. 5 shows a variation of the arrangement of FIG. 4, with the valve housing 19 being monolithically formed with the carburetor block 21, and with the inner chamber 29, the auxiliary air channel 4, and the internal thread 48 being introduced into the carburetor block 21 as a stepped bore 54. In contrast to the state shown in FIG. 4, with an increased differential pressure at the valve plate 18 after beginning of the automatic engine running, the valve plate 18 is raised from the valve seat 17 against the pre-load pressure of the compression spring 16. Formed between the peripheral side of the valve plate 18 and the threaded sleeve 20 is an annular gap 55. In this connection, the flow control device 9 is formed by the restrictor opening 14 and the gap 55, which from a flow dynamic standpoint is disposed parallel thereto. The intake air stream 28 is proportionally guided through the restrictor 14 and the gap 55, whereby the flow resistance of the flow control device 9 is reduced in comparison to the position of the valve plate 18 shown in FIG. 4. Consequently, in the region of the start opening 26 (FIG. 2) a lower underpressure, and hence a less rich fuel/air mixture 50, is established, with which after the starting process the internal combustion engine can reliably continue to run even if the butterfly valve 42 is closed.

The starting valve 10 shown in FIGS. 4 and 5 is embodied as a control valve that can be switched between two states and can have two different flow resistances, whereby the control valve is adapted to the flow resistance of the flow control device 9 as a function of the applied differential pressure. In this connection, the spring force and mass of the compression spring 16 and the valve plate 18 are coordinated such that intake pressure peaks that occur at a low speed of the internal combustion engine are evened out or compensated for. An embodiment as a continuously variable regulating valve can also be expedient, whereby, for example, a conical valve seat 17 is provided, and with which as a differential pressure increases, the flow resistance of the flow control device 9 constantly decreases.

The specification incorporates by reference the disclosure of German priority document 101 63 805.1 filed Dec. 22, 2001.

The present invention is, of course, in no way restricted to the specific disclosure of the specification and drawings, but also encompasses any modifications within the scope of the appended claims.

I claim:

1. A carburetion arrangement for an internal combustion engine of a manually guided implement, said arrangement comprising:

a first carburetor that is provided with an air channel, a cross-section of which is variable via a butterfly valve;

an auxiliary carburetor that is provided with an auxiliary air channel and that in a flow conducting manner is connected in parallel to said air channel of said first carburetor, wherein said auxiliary air channel opens into said air channel of said first carburetor downstream of said butterfly valve; and a starting valve that is disposed in said auxiliary air channel upstream of said auxiliary carburetor, and that includes a flow control device, wherein said starting valve alters a flow resistance of said flow control device as a function of a differential pressure that is present.

2. A carburetion arrangement according to claim 1, wherein said starting valve is embodied as a control valve that is switchable between two states having two different flow resistances.

3. A carburetion arrangement according to claim 1, wherein said auxiliary carburetor is provided with a shutoff valve.

4. A carburetion arrangement according to claim 3, wherein said shutoff valve is coupled with said butterfly valve.

5. A carburetion arrangement according to claim 4, wherein in a starting position of said butterfly valve that essentially sealingly closes off said air channel of said first carburetor, said shutoff valve is opened, and wherein in an operating position that at least partially opens said air channel of said first carburetor, said shutoff valve is closed.

6. A carburetion arrangement for an internal combustion engine of a manually guided implement, said arrangement comprising:

a first carburetor that is provided with an air channel, a cross-section of which is variable via a butterfly valve;

an auxiliary carburetor that is provided with an auxiliary air channel and that in a flow conducting manner is connected in parallel to said air channel of said first carburetor, wherein said auxiliary air channel opens into said air channel of said first carburetor downstream of said butterfly valve; and a starting valve that is disposed in said auxiliary air channel and that includes a flow control device, wherein said starting valve alters a flow resistance of said flow control device as a function of a differential pressure that is present, and wherein said starting valve includes a valve plate that is provided with a restrictor opening and is pressed against a valve seat by means of a preload of a spring element.

7. A carburetion arrangement according to claim 6, wherein a valve housing is provided, and wherein a threaded sleeve is provided that is threadable into said valve housing, whereby said preload of said spring element is adjustable via a depth of threading-in of said threaded sleeve.

8. A carburetion arrangement according to claim 7, wherein said threaded sleeve is provided with said valve seat.

9. A carburetion arrangement according to claim 7, wherein said valve housing is embodied as a screw-type fitting that is adapted to be threaded into a carburetor block of said first carburetor.

10. A carburetion arrangement according to claim 9, wherein at least one of said valve housing, said threaded sleeve, and said valve plate are made of polymeric material.

11. A carburetion arrangement according to claim 7, wherein said valve housing is monolithically embodied with a carburetor block of said first carburetor.

12. A carburetion arrangement according to claim 10, wherein said polymeric material is POM.

* * * * *